US006622446B1

(12) United States Patent
Ziegler

(10) Patent No.: US 6,622,446 B1
(45) Date of Patent: Sep. 23, 2003

(54) WELDLESS SPACER FOR WIRE REINFORCEMENT OF CONCRETE

(76) Inventor: Ed Ziegler, 9840 York Alpha Park Unit F, North Royalton, OH (US) 44133

( * ) Notice: Subject to any disclaimer, the term of this patent is extended or adjusted under 35 U.S.C. 154(b) by 0 days.

(21) Appl. No.: 09/656,365

(22) Filed: Sep. 6, 2000

(51) Int. Cl.[7] ..... E04C 5/16

(52) U.S. Cl. ..... 52/649.1; 52/664; 52/677; 52/684; 52/712; 52/719

(58) Field of Search ..... 52/677, 684, 686, 52/664, 712, 719, 685, 714, 649.1

(56) References Cited

U.S. PATENT DOCUMENTS 4,096,680 A * 6/1978 Ritter et al. ..... 52/665
4,301,638 A * 11/1981 Schmidgall ..... 52/687
4,996,816 A * 3/1991 Wiebe ..... 52/742
4,999,965 A * 3/1991 Schmidgall et al. ..... 52/684
5,878,546 A * 3/1999 Westover ..... 52/719
5,881,460 A * 3/1999 Nowell, III et al. ..... 29/897.34
6,128,882 A * 10/2000 Jones ..... 52/665

* cited by examiner

*Primary Examiner*—Carl D. Friedman
*Assistant Examiner*—Yvonne M. Horton
(74) *Attorney, Agent, or Firm*—John D. Gugliotta

(57) ABSTRACT

A weldless spacer for wire reinforcement of concrete is provided formed of a one piece, stamped design. An upper rail is formed parallel to a lower rail, and a series of vertical support elements are formed parallel to each other but perpendicular to both the upper rail and the lower rail. Flat plate stock, such as galvanized metal is used to formed a corrosion free spacer can supplant entirely the use of conventional reinforcing screens, but can be deployed and used in a manner similar to current conventional techniques.

3 Claims, 3 Drawing Sheets

WELDLESS SPACER FOR WIRE REINFORCEMENT OF CONCRETE

BACKGROUND OF THE INVENTION

1. Field of the Invention

The present invention relates generally to concrete reinforcement wire and more particularly, to a weld-less, self spacing and self supporting device for reinforcement of concrete.

2. Description of the Related Art

The use of reinforced concrete has revolutionized the construction industry, providing superior structural and load bearing characteristics while minimizing material costs. In laying reinforced concrete roads, a series of steel reinforcing screens are positioned in a continuous, grid-like fashion within the poured concrete area.

In pouring reinforced concrete, it is essential that the grid structure of the reinforcement bars be contiguous throughout each structural element so as to avoid forming weak spots in the structure. In doing so, conventional methods involve connecting adjoining reinforcing bars together either by welding or by overlapping their ends and wrapping them together with wire. In the latter scenario, the wrapping is typically done by hand and, as a result, can become labor intensive and time consuming.

The type of reinforcing screens most widely in use today consists of a pair of parallely spaced heavy gage steel wires, held approximately four inches apart by a series of spaced crosswires made of the same material. Each crosswire is welded at its top and bottom to each parallely spaced heavy gage steel wire, and extends outward slightly above and below. This screen is then stored and deployed in sections.

The strength of this conventionally available screens is independent of the gage of the wire, but is rather only as strong as the welds holding each wire to its crosswires. Also, because of the need to use welding at all, the materials used are limited to common steels, resulting in problems with corrosion.

Due to the tremendous number of linear feet of reinforcing screen as well as the associated supporting high-chair type spacers required for roadwork, until now no device has shown to be able to overcome these problems at a reasonably comparable cost.

Numerous attempts have been made to correct for the foregoing problems. For instance, U.S. Pat. No. 4,080,770, issued in the name of Vigh, discloses a high chair spacer for use in concrete construction and casting. However, a spacer made in accordance with this reference would be impractical, both in terms of material and in terms of installation labor, for use in pouring concrete roads.

Also, U.S. Pat. No. 4,452,026, issued in the name of Tolliver, discloses a spacer for wire reinforcement. Such a device, however, is used in conjunction with conventional wire screens, and serves only to increase the cost and installation difficulty.

And, in U.S. Pat. No. 5,896,722, issued in the name of Swensen, a weldless spacer is disclosed, but is best suited for spacing vertical rebar elements for structures such as walls and columns, not roads.

Finally, in U.S. Pat. No. 5,832,690, issued in the name of Kaines, a spacer for double cage concrete reinforcement wire grids is disclosed, but again is used in conjunction with conventional wire screens, and serves only to increase the cost and installation difficulty.

Consequently, a need has been felt for providing an apparatus and method which overcomes the safety and corrosion concerns of the present art without increasing installation costs or difficulty.

SUMMARY OF THE INVENTION

It is therefore an object of the present invention to provide an improved weldless spacer for wire reinforcement of concrete.

It is a feature of the present invention to provide an improved weldless spacer for wire reinforcement of concrete that can be made in a continuous, stamped fashion.

Briefly described according to one embodiment of the present invention, a weldless spacer for wire reinforcement of concrete is provided formed of a one piece, stamped design. Of a linear sectioned of a rectangular piece of metal an upper rail is formed parallel to a lower rail. A series of vertical support elements are notched therebetween, parallel to each other but perpendicular to both the upper rail and the lower rail. A window orifice is formed therebetween, and during the manufacturing process a rectangular cutout blank will be formed. Since it is envisioned that the manufacturing process will entail metal stamping on a continuous basis, although the cutout blank can be scrapped it is envisioned that additional functional elements, though unrelated to the present invention, can be incorporated directly into the die and thereby greatly reduce the amount of unused waste material.

An advantage of the present invention is that a spacer for wire reinforcement of concrete is provided that can supplant entirely the use of conventional reinforcing screen supports.

Another advantage of the present invention is that a spacer for reinforcement of concrete can be provided that is free of welded stress points.

Further, a preferred embodiment of the present invention can be formed of galvanized or other material, but can be deployed and used in a manner similar to current conventional techniques.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
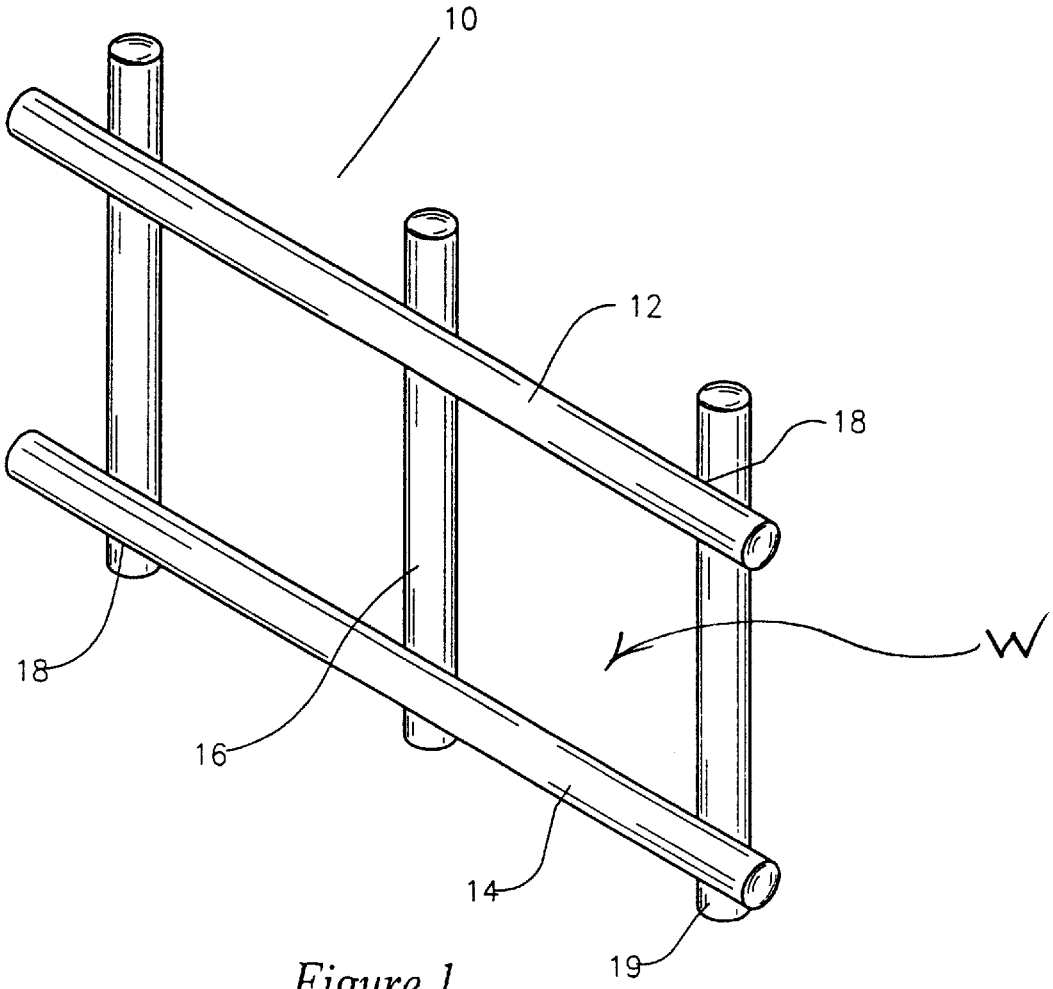
Figure 1 Prior Art
FIG. 1 is a perspective view of a reinforcing screen according to the conventional PRIOR ART.

In order to describe the complete relationship of the invention, it is essential that some description be given to the manner and practice of functional utility and description the prior art, as depicted in FIG. 1. Therein, a reinforcing screen 10 is provided of the type most widely in use today, consisting of a top wire 12 parallely spaced to a bottom wire 14. Each wire 12, 14 is formed of heavy gage steel wires, and are held approximately four inches apart by a series of spaced crosswires 16 made of the same material. Each crosswire 16 is welded 18 at its top and bottom to the top wire 12 and bottom wire 14, respectively, and extends outward slightly above and below to form an extension 19. This screen is then stored and deployed, usually strips in a linear serpentine formation.

Figure 2:
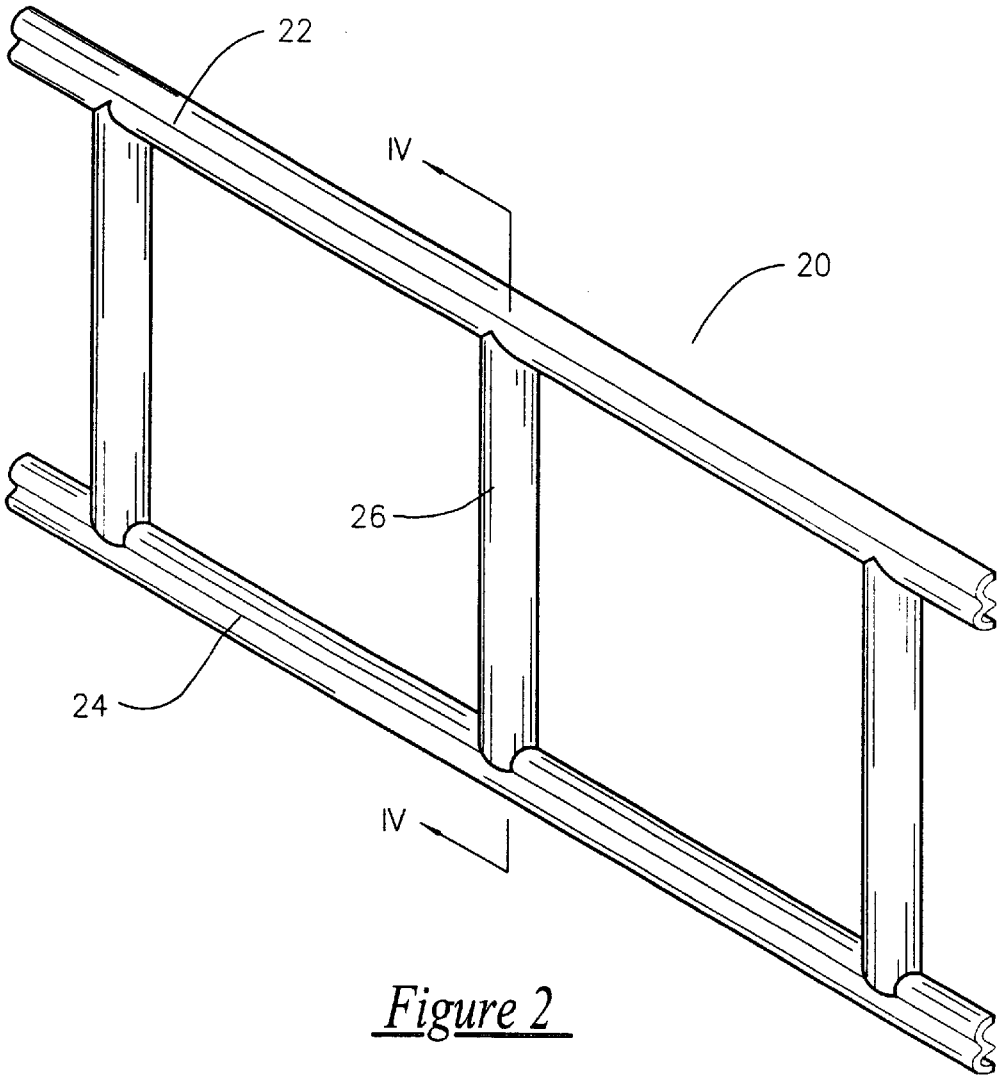
FIG. 2 is a perspective view of a weldless spacer for wire reinforcement of concrete according to the preferred embodiment of the present invention.
Figure 3:
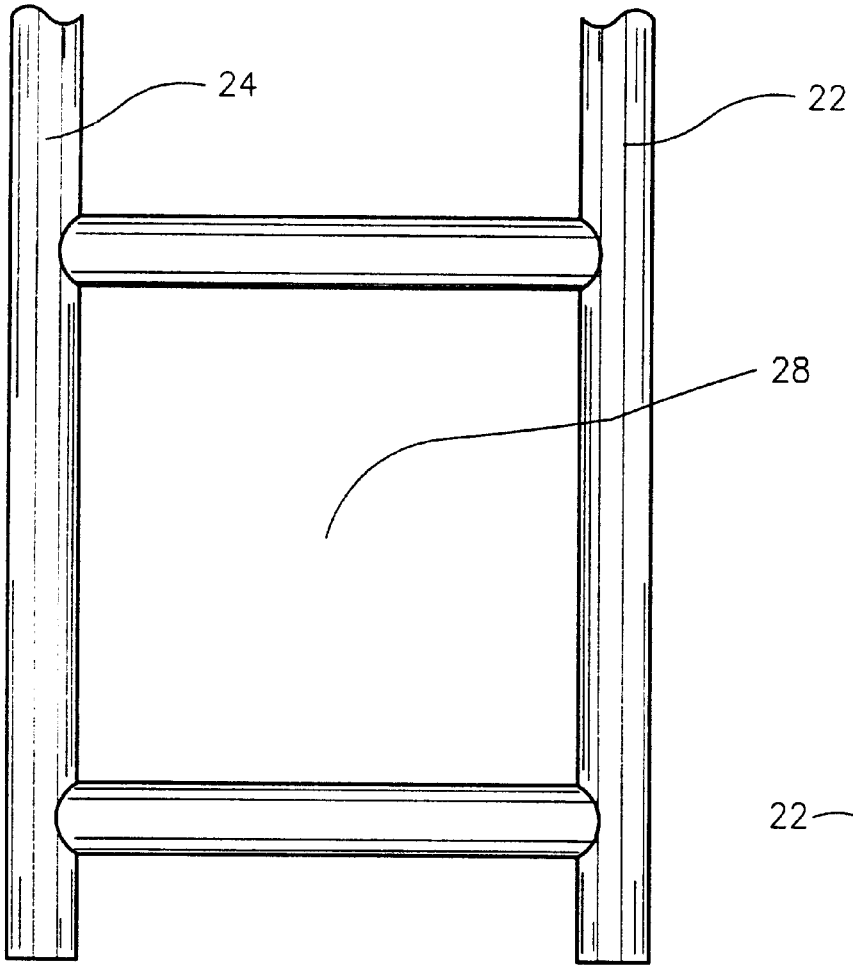
FIG. 3 is a front elevational view thereof.
Figure 4:
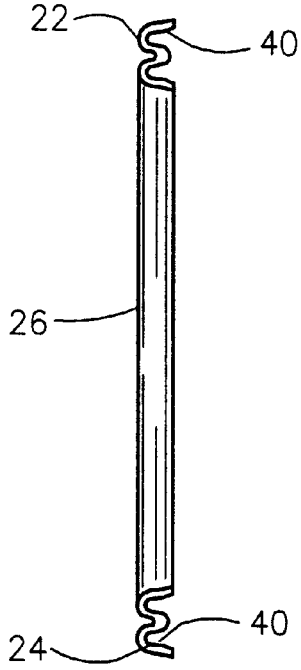
FIG. 4 is a cross sectional elevational view thereof taken along line IV—IV of FIG. 2.

The best mode for carrying out the invention is presented in terms of its preferred embodiment, herein depicted within the FIGS. 2–4.

1. Detailed Description of the Figures

Referring now to FIGS. 2–4, a weldless spacer 20 for wire reinforcement of concrete is provided formed of a one piece, stamped design. An upper rail 22 is formed parallel to a lower rail 24. A series of vertical support elements 26 are notched therebetween, parallel to each other but perpendicular to both the upper rail 22 and the lower rail 24. As shown best in FIG. 3, a window orifice 28 is formed therebetween, and during the manufacturing process a rectangular cutout blank (not shown) will be formed.

As best shown in FIG. 4, both the upper rail 22 and lower rail 24 are rolled to form a compound arc shape 40. Although any number of coss sectional shapes can form the upper rail 22 and lower rail 24 and provide sufficient structural rigidity and support, for purposes of disclosing the best mode as known to the inventor, a cross sectional "m" shape appears to provide superior structural rigidity and support in a commercially convenient and economical manner. Similarly, each vertical support element 26 will be formed into an arc shaped curve as well, either utilizing the similar "m" shaped cross section, or a more easily manufactured "c" shaped arc cross section. In this manner, tremendous structural rigidity, both vertically and horizontally, are created in both planes to the extent that exceeds that of the original flat stock material.

2. Operation of the Preferred Embodiment

In operation, the present invention is can supplant entirely the use of conventional reinforcing screens. The end users is capable of deployed and used in a manner similar to current conventional techniques, at a similar or reduced costs, without the safety concerns. Further, because a one-piece stamping is envisioned, each vertical support element is contiguously attached to the upper rail and lower rail, and no welding is required. This results in the elimination of stress points that can result in failure of the weld, and therefore the entire reinforcing mesh in a localized area. Another result of the use of stamping, and not welding, is that a variety of materials of construction can be used, including plated, clad, or coated metals, such as galvanized metals.

The foregoing description is included to illustrate the operation of the preferred embodiment and is not meant to limit the scope of the invention. The scope of the invention is to be limited only by the following claims.

What is claimed is:

1. A weldless spacer for reinforcement of concrete comprising:

an upper rail, wherein said upper rail forms a compound arc shaped cross shaped cross section that forms an "m" shape;

a lower rail formed parallel to said upper rail;

a series of vertical support elements affixed to both said upper rail and said lower rail, said vertical support elements parallel to each other but perpendicular to both said upper rail and said lower rail.

2. A weldless spacer for reinforcement of concrete comprising:

an upper rail, a lower rail formed parallel to said upper rail, wherein said lower rail forms a compound arc shaped cross shaped cross section that forms an "m" shape;

a series of vertical support elements affixed to both said upper rail and said lower rail, said vertical support elements parallel to each other but perpendicular to both said upper rail and said lower rail.

3. A weldless spacer for reinforcement of concrete comprising:

an upper rail, a lower rail formed parallel to said upper rail, a series of vertical support elements affixed to both said upper rail and said lower rail, said vertical support elements parallel to each other but perpendicular to both said upper rail and said lower rail, wherein each said vertical support element is formed into a compound arc shaped cross shaped cross section that forms an "m" shape.

* * * * *